US006445768B1

(12) United States Patent
Methley

(10) Patent No.: US 6,445,768 B1
(45) Date of Patent: Sep. 3, 2002

(54) X-RAY EXAMINATION APPARATUS

(75) Inventor: Peter Brian Methley, Eindhoven (NL)

(73) Assignee: Koninklijke Phillips Electronics N.V., Eindhoven (NL)

( * ) Notice: Subject to any disclaimer, the term of this patent is extended or adjusted under 35 U.S.C. 154(b) by 0 days.

(21) Appl. No.: 09/763,302

(22) PCT Filed: Jan. 15, 2000

(86) PCT No.: PCT/EP00/05595

§ 371 (c)(1),
(2), (4) Date: Feb. 20, 2001

(87) PCT Pub. No.: WO00/79842

PCT Pub. Date: Dec. 28, 2000

(30) Foreign Application Priority Data

Jun. 22, 1999 (EP) ..... 99201993

(51) Int. Cl.[7] ..... H05G 1/02
(52) U.S. Cl. ..... 378/101
(58) Field of Search ..... 378/101

(56) References Cited

U.S. PATENT DOCUMENTS 5,808,376 A * 9/1998 Gordon et al. ..... 378/101

FOREIGN PATENT DOCUMENTS

WO WO9617260 6/1996 ..... G01T/1/175

* cited by examiner

*Primary Examiner*—Craig E. Church

(57) ABSTRACT

An X-ray examination apparatus is provided with a high voltage generator for an X-ray tube and a number of additional power supply units for further components of the X-ray examination apparatus. There is also provided an input circuit which is to be connected to the mains and includes a current measuring circuit; the high-voltage generator and the additional power supply units are connected to the input circuit. The high voltage generator includes a rectifier unit and a power factor correction circuit which is connected thereto and is controlled, via the input circuit, in such a manner that the variation of the current drawn via the rectifier unit, together with that drawn by the additional power supply units collectively, is mainly sinusoidal and in phase with the mains voltage.

1 Claim, 2 Drawing Sheets

X-RAY EXAMINATION APPARATUS

The invention relates to an X-ray examination apparatus, including a high voltage generator for an X-ray tube and a number of additional power supply units for further components of the X-ray examination apparatus, there also being provided a power factor correction circuit.

The use of a power factor correction circuit in an X-ray examination apparatus is known from international patent application WO-A 96/17260. Therein, power factor correction is applied so as to correct the phase difference between the voltage and the current on the input leads, which difference is caused by the input impedance of the apparatus. The known X-ray examination apparatus includes a central power supply unit wherefrom the supply voltages for the X-ray tube and the further components are derived. The power factor correction circuit forms part of said central power supply unit. However, in practice there will often be a situation where individual power supply units are provided for the further components in the X-ray examination apparatus; in that case the method of applying the power factor correction as disclosed in the cited publication cannot be used.

Nowadays it is customary to apply power factor correction to the power supply for a variety of apparatus, particularly when a non-sinusoidal, notably a peak or pulse-shaped current is derived therefrom; this correction will be referred to hereinafter as PF correction. The power factor or PF is the ratio of the actual power to the apparent power. When a phase difference exists between an alternating voltage and an alternating current or a peak or pulse-shaped current, the PF may deviate significantly from the value "1" and may even become negative, depending on the phase difference or the pattern of the current variation. In the case of a sinusoidal voltage and current variation, the power factor is represented by the cosine of the phase difference between the two of them. In the case of a peak or pulse-shaped current variation, the current shape can be subdivided into a number of components of different frequency, i.e. the harmonics, which individually exhibit a phase difference with respect to the alternating voltage. The component having the main frequency delivers the actual power whereas the other components are responsible for the losses occurring. A PF correction circuit in principle matches the current variation with the voltage variation, that is to say, in such a manner that the PF assumes substantially the value "1". Consequently, after PF correction a substantially higher actual power can be extracted from the mains. When such a PF correction circuit is incorporated in the high voltage generator, therefore, a higher actual power will become available to this generator. However, this does not yet offer optimum use of the available power. If PF correction were also applied to all additional power supply units, the power available to the high voltage generator could be further increased. However, it is comparatively expensive to provide all such power supply units with a PFC circuit; moreover, the overall design of the complete apparatus must be attuned to such modified power supply units.

It is an object of the invention to mitigate this problem at least significantly and to provide an X-ray examination apparatus in which power factor correction is realized for the entire system, without providing the individual additional power supply units with a power factor correction circuit.

To this end, the X-ray examination apparatus of the kind set forth according to the invention is characterized in that there is provided an input circuit which is to be connected to the mains and includes a current measuring circuit, the high voltage generator and the additional power supply units being connected to said input circuit, the high voltage generator being provided with a rectifier unit whereto there is connected the power factor correction circuit which is controlled via the input circuit in such a manner that the variation of the current drawn via the rectifier unit, together with that drawn by the additional power supply units collectively, is mainly sinusoidal and in phase with the main voltage.

The invention will be described in detail hereinafter with reference to the accompanying drawing. Therein:

Assuming that the variation of the voltage and the current at the input of an apparatus connected to the mains is sinusoidal and represented by $E=E_0 \cos \omega t$ and $I=i_0 \cos(\omega/t+\psi)$, it holds that the product of the effective voltage and the effective current or the apparent power (expressed in VA) can be represented by $P_a=\frac{1}{2}E_0 i_0$ and the mean value over a mains period of the product of the instantaneous voltage and the instantaneous current or the actual power (expressed in W) by $P_r=\frac{1}{2}E_0 i_0 \cos \psi$. The PF then equals $\cos \psi$. In practice, however, the variation of the current will usually not be sinusoidal but pulse-shaped. The above consideration, therefore, represents merely in approximation intended to illustrate how the power to be drawn from the mains can be increased by PF correction, notably in a manner in conformity with the invention.

Figure 1:
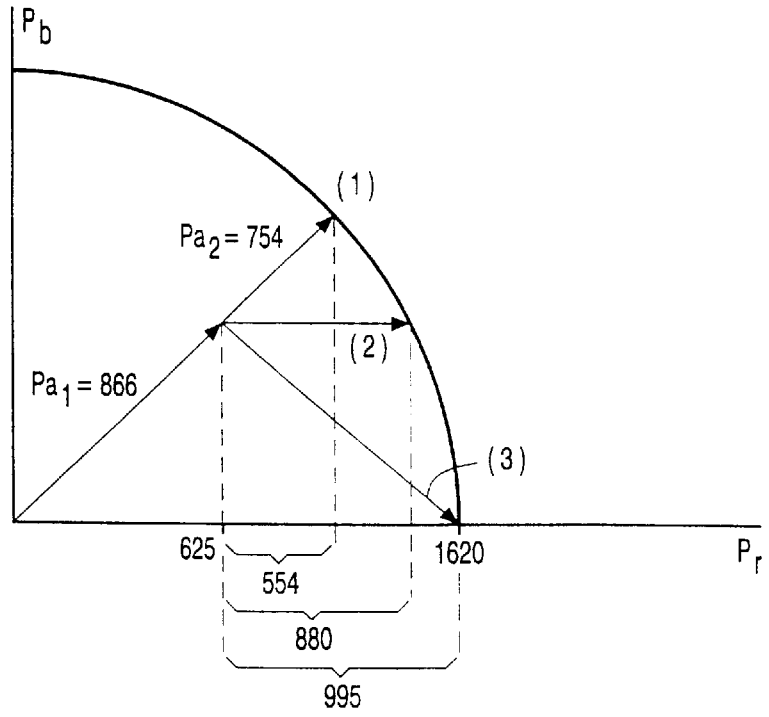
FIG. 1 shows a diagram illustrating how a maximum power can be drawn from the mains.

For example, in the case of an X-ray examination apparatus with a number of additional power supply units which collectively take up an apparent power $P_{al}$=866 VA and an actual power $P_{rl}$=625 W in the standby mode, and assuming that the high voltage generator has the same PF as the additional power supply units together in the standby mode and also assuming that the total power that can be drawn from the mains then amounts to 1620 W, it appears that an actual power of only 554 W (apparent power according to the vector (1)) is available without PF correction, whereas in the case of PF correction for the high-voltage generator alone the power actually available to this unit amounts to 880 W (apparent power=actual power according to the vector (2)). The foregoing is shown in FIG. 1, in which the reactive power $P_b$ is plotted vertically and the actual power $P_r$ is plotted horizontally. Due to the pulse-like variation of the current drawn by the additional power supply units in the standby mode, in practice a value of no more than 700 W will be obtained instead of a value of 880 V, without the effective current having reached its maximum value. If in this example PF correction is applied to the entire system in a manner according to the invention, the actual power made available to the high voltage generator can be increased to as much as 995 W (apparent power according to the vector (3)). Such a situation is reached in the embodiment to be described hereinafter in that the variation of the current drawn by the high voltage generator equals a sinusoidal variation, being in phase with the mains voltage, minus the pulse-shaped variation of the current drawn by the additional power supply units.

Figure 2:
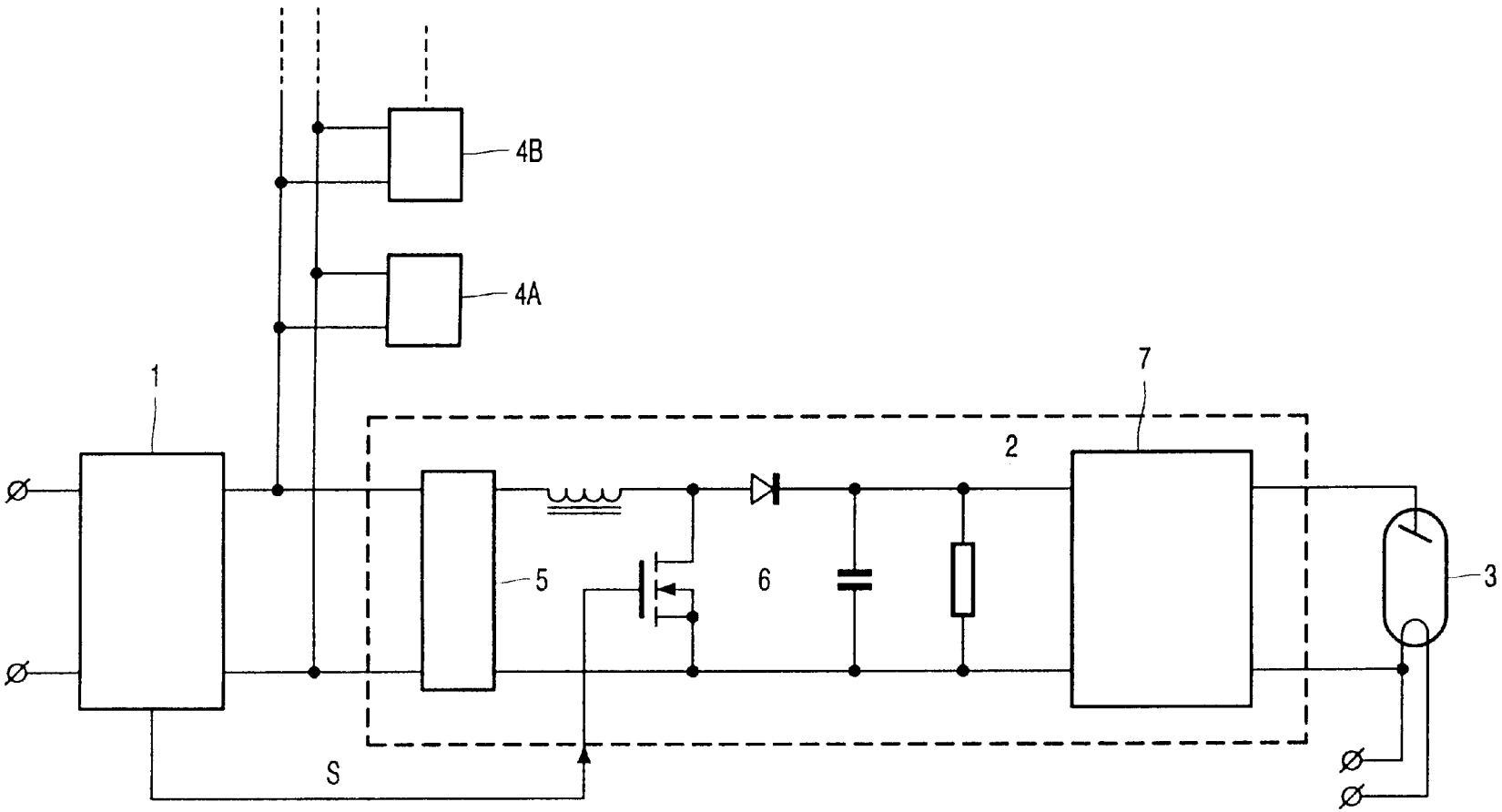
FIG. 2 shows a block diagram of an embodiment of the power supply section of an X-ray examination apparatus according to the invention.

The embodiment of the power supply section of an X-ray examination apparatus according to the invention which is shown in the form of a block diagram in FIG. 2 includes an input circuit 1 with a current measuring circuit; the apparatus can be connected to the mains via said input circuit. A high voltage generator 2 for an X-ray tube 3 and a number of power supply units 4*a*, 4*b* etc. for further parts or components of the X-ray examination apparatus are connected to the input circuit 1. The high voltage generator 2 is composed of a rectifier unit 5, a PF circuit 6 and a high voltage power supply section 7. In the embodiment shown in FIG. 2 the PF circuit is constructed in the manner described in, for example, Danis Carter: Power factor correction for medical power supplies, EDN May 7, 1998, pp. 81–88, however, the PF circuit 6 being controlled via the input circuit 1. The PF circuit 6 is controlled in such a manner that the variation of the current drawn by the high voltage generator 2, together with that drawn by the additional power supply units 4*a*, 4*b*, etc. collectively, is mainly sinusoidal and is in phase with the mains voltage.

Figure 3:
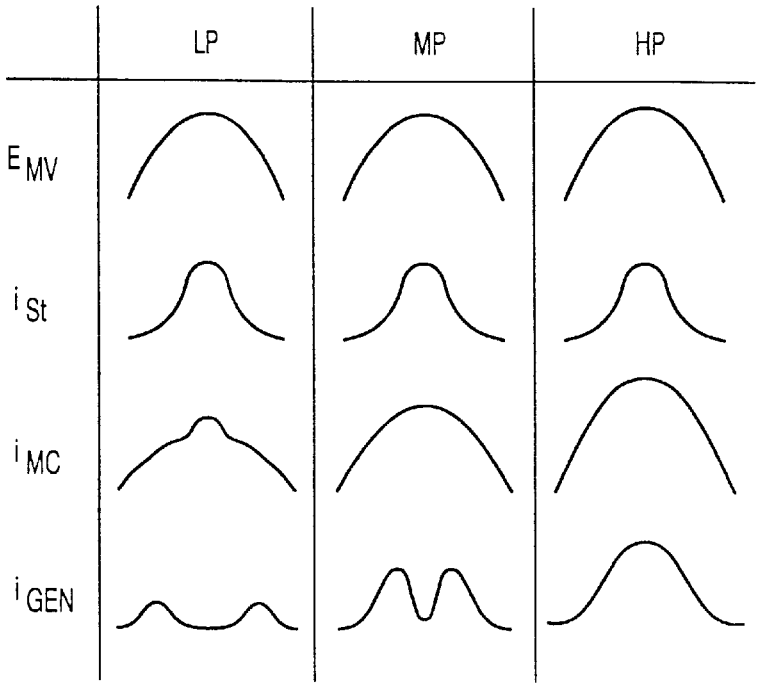
FIG. 3 shows a number of diagrams illustrating the variation of the mains voltage, the mains current, the current drawn by the high-voltage generator, and the currents drawn by the further power supply units.

FIG. 3 shows the variation, over one half period, of the mains voltage EMV, the current $i_{Gen}$ drawn by the power supply units 4*a*, 4*b*, etc. collectively, the mains current $i_{MC}$ and the current $i_{Gen}$ drawn by the high-voltage generator, that is to say for three situations: the situation where a comparatively low power (LP) is drawn by the high voltage generator, the situation where a more or less mean power (MP) is drawn by this generator, and the situation where a comparatively high power (HP) is drawn by the generator. The variation of the mains voltage $E_{MV}$ is mainly sinusoidal. The current $i_{St}$ drawn by the power supply units is peak or pulse-shaped. The current $i_{Gen}$ drawn by the generator should be controlled so that, together with the current $i_{St}$, this current yields the mainly sinusoidal current $i_{MC}$, $i_{MC}$ being in phase with $E_{MV}$. On the basis of the results of the current measurement in the input circuit, the MOSFET in the PF circuit 6 is driven until the measured current is mainly sinusoidal. The PF circuit, even though included exclusively in the high-voltage generator, is always active for the entire system, regardless of how many additional power supply units are drawing current.

It is to be noted that the described supply section for an X-ray examination apparatus is suitable for a system in the "boost" mode as well as in the "buck" mode. In the latter case the high voltage generator 5 will have an isolating transformer connected to its input.

What is claimed is:

1. An x-ray examination apparatus, comprising:

an x-ray tube;

a high voltage power supply section electrically connected to the x-ray tube;

a power factor correction circuit electrically connected to the high voltage power supply section;

a rectifier circuit electrically connected to the power factor correction circuit; and an input circuit including a current measuring circuit connected to the rectifier, a main power supply and at least one additional power supply;

wherein the current measuring circuit generates a power correct signal which is used by the power factor correction circuit to maintain that current drawn by the rectifier circuit and the at least one additional power supply is substantially in phase with a voltage signal provided by the main power supply.

* * * * *